US005110140A

United States Patent [19]

Breslow et al.

[11] Patent Number: 5,110,140

[45] Date of Patent: May 5, 1992

[54] GAME INCLUDING CARD DISPLAY TIMER

[75] Inventors: Jeffrey D. Breslow, Highland Park; Howard J. Morrison, Riverwoods, both of Ill.

[73] Assignee: Breslow, Morrison, Terzian et al., Chicago, Ill.

[21] Appl. No.: 651,760

[22] Filed: Feb. 7, 1991

[51] Int. Cl.[5] ..... A63F 9/00

[52] U.S. Cl. ..... 273/459

[58] Field of Search ..... 273/459, 460, 445, 446, 273/432, 148 A, 292

[56] References Cited

U.S. PATENT DOCUMENTS 3,949,986 4/1976 Breslow ..... 273/459

4,114,877 9/1978 Golofarb et al. ..... 273/445

*Primary Examiner*—Paul E. Shapiro

*Attorney, Agent, or Firm*—Dick and Harris

[57] ABSTRACT

A game for a number of players that includes a device for displaying one or more cards for a limited amount of time, with all of the cards initially being displayed. Each of the initially displayed cards drops into a housing after a limited amount of time which, in the preferred embodiment, is a different amount of time for each of the displayed cards. Players take turns trying to convey the words on the displayed cards to teammates using non-verbal communication and grab the cards before they drop into the housing.

8 Claims, 1 Drawing Sheet

GAME INCLUDING CARD DISPLAY TIMER

BACKGROUND OF THE INVENTION

1. Field of the Invention

This invention relates generally to games and more particularly to games in which players are required to convey messages that appear on a card within a limited amount of time.

2. Background Art

Games such as "CHARADES" in which players, by sign language, gestures and other nonverbal forms of communication, try to have one or more teammates guess words or phrases have long been popular. Breslow U. S. Pat. No. 3,949,986 issued Apr. 13, 1976 discloses a card displaying device for permitting sequential visual observance of one or more message carrying cards in which a central rotatable drum carrying the cards rotates relative to an outer cylindrical wall have an aperture permitting one card at a time to be viewed for a limited amount of time. Hanson et al. U. S. Pat. No. 4,524,967 issued Jun. 25, 1985 discloses an action matching game in which a number of figurines that are to be matched with corresponding cards are removably supported on two concentric coplanar annular plates which function as a cam follower for simultaneous raising and lowering of the figurines through openings by a motor driven cam. There remains a need, however, for additional games employing devices for timed display of one or more cards to provide an interesting and entertaining variation of the long popular "CHARADES" game.

SUMMARY OF THE INVENTION

The present invention is concerned with providing a game that includes a device for displaying one or more cards for a limited amount of time, with all of the cards initially being displayed. Each of the initially displayed cards drops into a housing after a limited amount of time which, in the preferred embodiment, is different for each of the displayed cards.

BRIEF DESCRIPTION OF THE DRAWINGS

For a better understanding of the present invention, reference may be had to the accompanying drawings in which.

DETAILED DESCRIPTION

Figure 1:
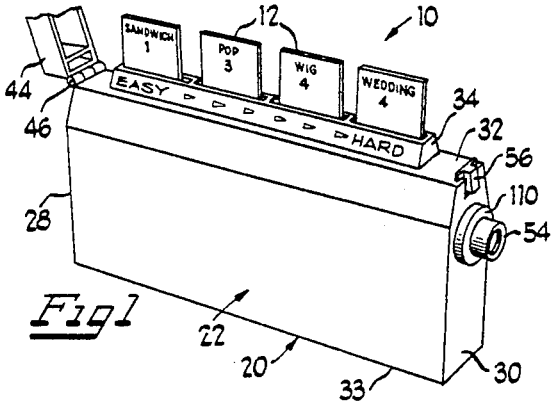
FIG. 1 is a perspective view of an embodiment of the present invention.
Figure 3:
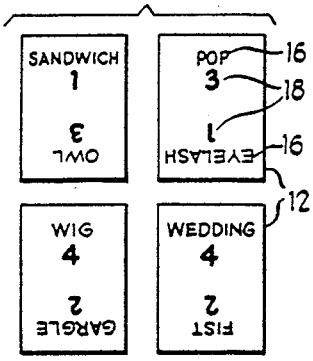
FIG. 3 is a top plan view of the face of exemplary cards forming part of the present invention.
Figure 4:
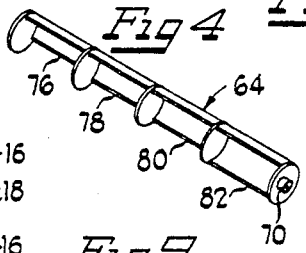
FIG. 4 is a perspective view of the roller contained within the housing shown in FIGS. 1 and 2.
Figure 7:
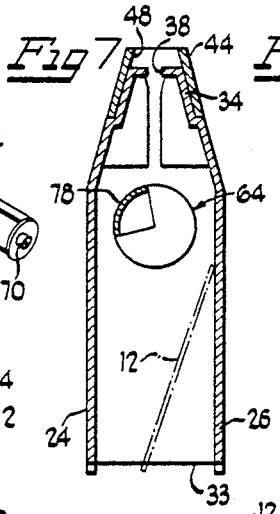
FIG. 7 is a sectional view taken generally along line 7—7 of FIG. 5.
Figure 6:
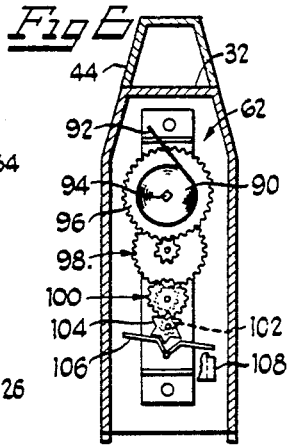
FIG. 6 is a sectional view taken generally along line 6—6 of FIG. 5.
Figure 9:
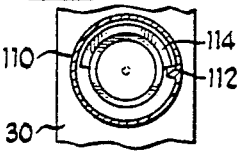

Referring now to the drawings in which like parts are designated by like reference numerals throughout the several views, there is shown in FIG. 1 a game 10 including a plurality of cards 12. For ease of illustration, only the faces of four exemplary cards are shown in the drawings although the actual game would contain a large plurality of such cards. It may even be convenient to provide more than one set of the cards, which could be distinguished from other sets by a different design and/or color on the backside (not shown). The purpose of such additional cards would be to provide greater variation in the available words, the meaning of which a player is to convey by nonverbal communication such as sign language and gesturing. Different sets could contain words with different degrees of difficulty so that different sets would be used with participants of different age groups. Alternatively, the different sets could be used within the play of a particular match to provide different rounds of play. As is illustrated in FIG. 3, each card can contain two different words 16 adjacent an opposite edge of the card. Accompanying each word 16 is a numerical point value 18, which conveniently ranges from "1" to "4" points. Thus, each word on a card, and its point value, adjacent an edge are readable when that particular edge is directed upwardly.

Game 10 also includes a timer display device 20 having a generally rectangular hollow housing 22 with opposed, spaced apart sides 24 and 26. Opposed, spaced apart ends 28 and 30 are generally transverse to spaced apart sides 24 and 26. Generally transverse to both sides 22 and 24, as well as ends 28 and 30, is a top wall and an open bottom 33. Top wall 32 includes a raised cowling 34 that is generally centrally disposed with respect to top 32. Cowling 34 defines a series of four spaced apart slots 36, 38, 40 and 42, each of which is generally of the same length and receives one of cards 12.

Figure 2:
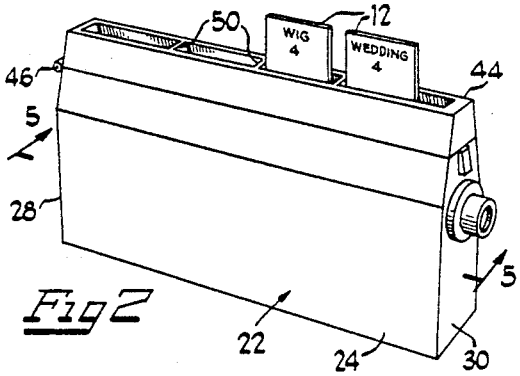
FIG. 2 is another perspective view showing a subsequent phase of operation from that shown in FIG. 1.

A cover 44 is connected to housing 22 by a hinge 46 that lies along the juncture of end wall 28 and top wall 32. Cover 44 includes an elongated slot 48 and has transverse partitions 50 for dividing the slot. As is shown in FIG. 2, cover 44 is adapted to fit over top wall 32 and cowling 34. End wall 30 carries a rotatable knob 54 as well as a slideable actuator switch 56. In the off position, as is best shown in FIG. 1, the top of switch 56 is slid up above top wall 32. Accordingly, when cover 44 is moved to the closed position, as in FIG. 2, cover 44 engages and pushes down switch 56.

Figure 5:
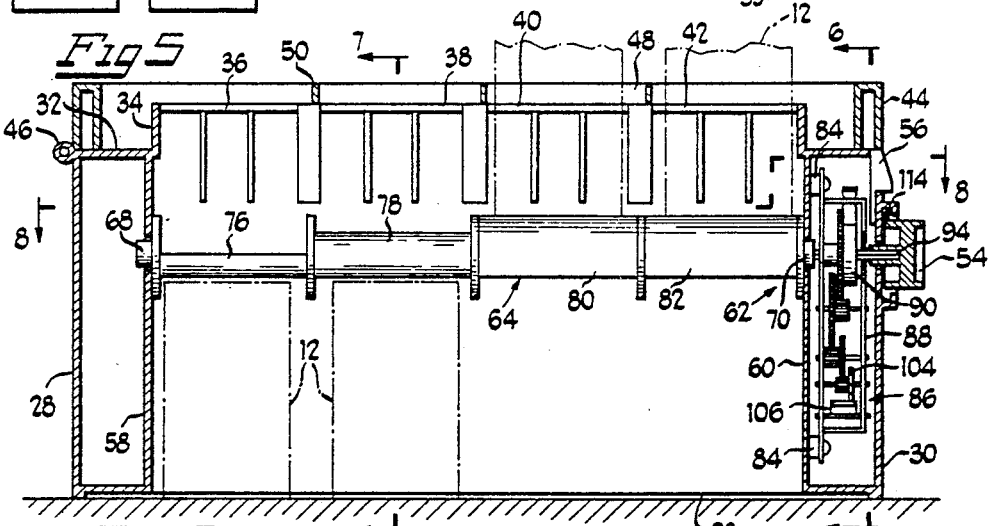
FIG. 5 is an enlarged scale, sectional view taken generally along line 5—5 of FIG. 2.
Figure 8:
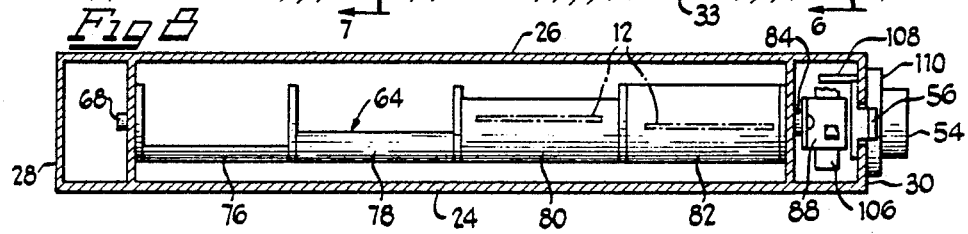
FIG. 8 is a sectional view taken generally along line 8—8 of FIG. 5.

As is best shown in FIG. 5, housing 22 includes spaced apart inner end walls 58 and 60. Together, relatively closely spaced apart end wall 28 and inner end wall 58 form one end of housing 22 while relatively closely spaced apart end wall 30 and inner end wall 60 form the other end. The closely spaced apart pairs of walls not only strengthen housing 22 but facilitate mounting of the timer mechanism, generally designated 62, within housing 22.

Within housing 22 is an elongated timer support roller 64, including coaxial trunnions 68 and 70 that are respectively journaled for rotation in inner end walls 58 and 60. Support roller 64 is divided into four, generally equal length, sections 76, 78, 80 and 82 which each correspond with, and are disposed immediately below, a respective one of slots 36, 38, 40 and 42. Each of sections 76, 78, 80 and 82 comprises a segment of a peripheral surface of a cylinder having an arc that is not substantially greater than one hundred and eighty degrees. In addition, the arc of each segment is different than arc of every other one resulting in a different extent of peripheral support surface below each slot. Preferably each arc is an integral multiple of one hundred and eighty degrees divided by the number of segments. Thus, in the embodiment shown and described, the arc of segment 76 is approximately forty-five degrees, the arc of segment 78 is approximately ninety degrees, the arc of segment 80 is approximately one hundred and thirty-five degrees and the arc of segment 82 is approximately one hundred and eighty degrees.

Mounted between end wall 30 and inner end wall 60, on bosses 84, is a spring wound governed motor 86. The motor includes a frame 88 that is secured to bosses 84 by means of screws, heat staking or the like. Within frame 88 is a coil spring 90 having one end 92 secured to frame 88. Spring 90 is coiled about, and secured at, its other end for rotation with a square drive shaft 94. Secured for rotation to shaft 94 is a drive gear 96 which engages idler gear sets 98 and 100 to drive a pinion 102 mounted for coaxial rotation with star escapement wheel 104. Gear set 100 is mounted in slots (not shown) in frame 88 for sliding movement so that during winding of spring 90, gear set 100 is driven by gear set 98 out of engagement with pinion 102. However, during unwinding of spring 90, the reverse rotation of the gear sets slides gear set 100 into engagement with pinion 102 to rotate star wheel 104. Rotation of star wheel 104 during unwinding of spring 90 is limited by engagement with the pivotally mounted oscillating governor leaf 106 to maintain the speed of rotation of shaft 94 relatively constant.

One end of shaft 94 is received in trunnion 70, in driven engagement with trunnion 70, and hence timer support roller 64. Also in driven engagement with the other end of square shaft 94 is knob 54. Clockwise rotation of knob 54, as illustrated in the drawings, winds motor 86, or more particularly spring 90. When actuator switch 56 is slid upwardly, a tab 108 carried at the lower end of switch 56 moves up into engagement with governor 106 and blocks the governor from oscillating and thus effectively stops motor 86. Moving actuator switch 56 down, such as by closing cover 44, moves tab 108 out of blocking engagement with oscillator 106 and operation of motor 86 is thus actuated.

End wall 30 includes a ring 110 that surrounds rotatable knob 54. Ring 110 includes an inwardly directed detent 112. Rotatable knob 54 includes an outwardly directed flange 114 extending through an arc of slightly less than one hundred and eighty degrees to limit rotation of knob 54, and hence rotation of support roller 64 to approximately one hundred and eighty degrees. The difference between the arc of flange 114 and one hundred eighty degrees is to accommodate the width of detent 112.

With timer support roller 64 in its initial at rest position, the periphery of each of segments 76, 78, 80 and 82 is disposed below a respective one of each of slots 36, 38, 40 and 42 such that the bottom edge of a card inserted through one of the slots would be supported by the periphery of the respective section with the word and numerical point value adjacent the upward edge of the card displayed. Even after cover 44 is closed, the word and numeral point value adjacent the upward edge of each of the cards will continue to be visible to the player toward whom side 24 of the housing is facing. When cover 44 is closed, actuator 56 is moved downwardly and motor 86 is actuated resulting in support roller 64 beginning to rotate. Once roller 64 rotates through an initial forty-five degree arc, the card in slot 36 will no longer be supported by peripheral segment 76 and that card will drop down into housing 22. As roller 54 continues to rotate through additional sequential forty-five degree arcs, the support for the cards in each of the other slots will sequentially disappear by dropping down into housing 22. Conveniently, housing 22 has open bottom 33 so that after all four cards have dropped into the housing, the housing may merely be picked up to retrieve the cards.

To play the game of the present invention, a player selects four cards containing words or phrases that the player wishes to try and convey to one or more teammates. The selected cards are placed in the slots of timer device 20 with the desired words adjacent the upward edge of each of the cards facing the player who has to mime or otherwise convey them. As indicated by the words "easy" and "hard" adjacent respective ends of cowling 34, it is recommended that the player insert the card containing the word the player believes will be easiest to covey in slot 36 as that will be the first card to drop down out of sight. The cards containing the progressively more difficult words are placed in slots 38, 40 and 42, respectively. After the player successfully conveys the word or phrase appearing on a card by nonverbal communication such as pointing to parts of the player's own body or other things in the room or by using "CHARADES" game signs such as tugging on an ear to indicate "sounds like", and the player's one or more teammates call out the word, the player must still grab the card before it drops into the housing in order to score the points for the word.

While a particular embodiment of the present invention has been shown and described, variations and modifications will occur to those skilled in the art. It is intended in the appended claims to cover all such variations and modifications as fall within the true spirit and scope of the present invention.

What is claimed as new and desired to be secured by Letters Patent is:

1. A game comprising in combination:
a plurality of cards; and
means for displaying a number less than the plurality of the cards with each of the number being displayed for a different limited period of time.

2. The game of claim 1 in which the display means includes:
a rotatable support;
a motor;
means connecting the motor for driving rotation of the support; and
means limiting the amount of rotation of the support.

3. The game of claim 2 in which:
the support has an axis;
the support is elongated along its axis;
the support is divided into a number of generally equal length sections along its axis; and
each of the sections comprises a cylindrical segment of a different arcuate size than every other segment.

4. The game of claim 2 in which:
the display means further includes a housing having a top and opposed end walls;
the rotatable support has ends journaled for rotation in the end walls below the top;
the top has a number of generally aligned slots disposed above the rotatable support;
the rotatable support is divided into a number of sections between the journaled ends; and
each section has a peripheral support surface disposable below a respective one of the slots.

5. The game of claim 4 in which the extent of peripheral support surface disposal below each slot is different.

6. The game of claim 5 in which the extent of the peripheral support surface is approximately equal to an integral multiple of one hundred and eighty degrees divided by the number of sections.

7. A game comprising in combination:

a plurality of cards;

a housing;

the housing having a top and a bottom;

the housing having opposed ends generally transverse to the top and to the bottom;

a rotatable support disposed below the top and carried for rotation between the ends;

the top having a wall, a slot in the wall for receiving a card; and the rotatable support having a periphery of not substantially more than one hundred and eighty degrees.

8. The game of claim 7 in which:

the rotatable support is divided into a number of sections between the ends; and each section of the rotatable support has an arcuate periphery approximately equal to an integral multiple of one hundred and eighty degrees divided by the number of sections.

* * * * *